US007303270B2

(12) United States Patent
Arakawa et al.

(10) Patent No.: US 7,303,270 B2
(45) Date of Patent: Dec. 4, 2007

(54) INK-JET HEAD

(75) Inventors: Masayuki Arakawa, Nagoya (JP); Shingo Hattori, Tsushima (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 279 days.

(21) Appl. No.: 10/822,045

(22) Filed: Apr. 9, 2004

(65) Prior Publication Data

US 2004/0257415 A1 Dec. 23, 2004

(30) Foreign Application Priority Data

Apr. 10, 2003 (JP) ..... 2003-106119

(51) Int. Cl.
*B41J 2/175* (2006.01)
*B41J 2/045* (2006.01)

(52) U.S. Cl. ..... 347/93; 347/71

(58) Field of Classification Search ..... 347/68–72, 347/93

See application file for complete search history.

(56) References Cited

U.S. PATENT DOCUMENTS

| | | | | |
|---|---|---|---|---|
| 5,489,930 | A * | 2/1996 | Anderson | 347/71 |
| 5,907,338 | A * | 5/1999 | Burr et al. | 347/43 |
| 6,120,140 | A | 9/2000 | Hirosawa et al. | |
| 6,158,855 | A | 12/2000 | Saikawa | |
| 2002/0012034 | A1 | 1/2002 | Saikawa | |
| 2002/0196318 | A1 | 12/2002 | Shimizu | |

FOREIGN PATENT DOCUMENTS

| | | |
|---|---|---|
| EP | 0 645 244 A1 | 3/1995 |
| EP | 0 683 050 A2 | 11/1995 |
| JP | 62-257857 | 11/1987 |
| JP | 7117239 | 5/1995 |
| JP | 7314705 | 12/1995 |
| JP | 2003-1847 | 1/2003 |

* cited by examiner

*Primary Examiner*—Stephen Meier
*Assistant Examiner*—Geoffrey S. Mruk
(74) *Attorney, Agent, or Firm*—Reed Smith LLP

(57) ABSTRACT

An ink-jet head comprises a joint member having an ink outlet port out of which ink supplied from an ink supply source flows, and a passage unit having an ink receiving port that receives the ink flowing out of the ink outlet port of the joint member. A filter is disposed within a first ink passage inside the passage unit. The first ink passage extends in the same direction as an ink flow direction from the ink outlet port to the ink receiving port. In the first ink passage of the passage unit, a first space is formed between the ink receiving port and the filter, and a second space is formed contiguous to the first space with the filter interposed between the first and second spaces within the first ink passage. The cross-sectional shape and size of each space in a direction perpendicular to an ink flow direction are constant along the ink flow direction.

6 Claims, 8 Drawing Sheets

INK-JET HEAD

BACKGROUND OF THE INVENTION

1. Field of the Invention

The present invention relates to an ink-jet head in which an ink passage has a filter therein.

2. Description of Related Art

An ink-jet recording apparatus that ejects ink to form an image comprises an ink-jet head having many nozzles for ejecting ink and also having therein ink passages that lead to the nozzles. The ink-jet head, having an ink receiving port for receiving ink from an ink tank, is connected to the ink tank via a tube, etc., so that ink may be supplied from the ink tank through the ink receiving port into the head.

In such a tube-connection type head, in general, a joint member is disposed between the ink receiving port and the tube. In a known technique, for example, a joint member has two conical members confronting each other on their open bottoms to define therein two funnel shaped spaces, and a filter for removing dust contained in ink is disposed between the two funnel shaped spaces (see U.S. Patent Application Publication No. 2002-196318).

In this technique, an ink passage formed by the two funnel shaped spaces becomes relatively larger at its portion around the filter. With this configuration, flow velocity and pressure of ink fall around the filter, to often generate bubbles resulting from air contained in ink. The bubbles may hinder ink flow through the filter, enter an ink passage of the head to deteriorate election performance, and, in the worst case, cause failure of ink ejection.

SUMMARY OF THE INVENTION

An object of the present invention is to provide an ink-jet head capable of suppressing generation of bubbles around a filter.

A continued study by the present inventors has revealed that the foregoing object can be achieved by properly defining configurations of spaces that are formed on upstream and downstream sides of a filter disposed within an ink passage.

According to a first aspect of the present invention, there is provided an ink-jet head comprising a joint member, a passage unit, and a filter. The joint member has an ink outlet port out of which ink supplied from an ink supply source flows. The passage unit has a layered structure of a plurality of sheet members. The passage unit includes an ink receiving port that confronts the ink outlet port and receives the ink flowing out of the ink outlet port, and an ink passage that extends from the ink receiving port in a layered direction of the sheet members and subsequently extends in a plane direction of the sheet members that is perpendicular to the layered direction. The filter is disposed in a portion of the ink passage extended in the layered direction. The ink outlet port has a smaller area than the ink receiving port, the joint member has a flat face that confronts the passage unit and surrounds the ink outlet port. In the portion of the ink passage extended in the layered direction, a straight columnar space is formed between the ink receiving port and the filter, and another straight columnar space is formed between the filter and one of the sheet members on a downstream side of the filter.

In the aforementioned construction, straight columnar spaces are formed between the ink receiving port and the filter, and between the filter and one of the sheet members on a downstream side of the filter, in the portion of the ink passage extended in the layered direction. As a result, ink that flows from the ink outlet port of the joint member through the ink receiving port of the passage unit into the ink passage in the passage unit is hardly decreased in flow velocity and pressure around the filter. Therefore, since air contained in ink is unlikely to develop into bubbles, generation of bubbles around the filter can be suppressed.

According to a second aspect of the present invention, there is provided an ink-jet head comprising a joint member, a passage unit, and a filter. The joint member has an ink pathway through which ink supplied from an ink supply source passes, an ink outlet port formed at one end of the ink pathway, and a space which is formed in the vicinity of the one end of the ink pathway and whose cross-sectional shape and size in a direction perpendicular to an ink flow direction toward the ink outlet port are constant along the ink flow direction. The passage unit has a plurality of nozzles that eject ink, an ink receiving port that is larger than the ink outlet port and receives the ink flowing out of the ink outlet port, a first ink passage that has, at one end thereof, the ink receiving port and extends in the same direction as the ink flow direction toward the ink outlet port, and a second ink passage that extends from the other end of the first ink passage to the nozzles. The passage unit is connected to the joint member such that the ink receiving port confronts the ink outlet port. The filter is disposed within the first ink passage of the passage unit. A first space is formed between the ink receiving port and the filter. A cross-sectional shape and size of the first space in the direction perpendicular to the ink flow direction are constant along the ink flow direction. A second space is formed on a downstream side of the filter within the first ink passage. A cross-sectional shape and size of the second space in the direction perpendicular to the ink flow direction are constant along the ink flow direction. The first space and the second space are contiguous to each other with an interposition of the filter.

In the aforementioned construction, the space whose cross-sectional shape and size in the direction perpendicular to the ink flow direction are constant along the ink flow direction is formed in the vicinity of one end of the ink pathway of the joint member at which the ink outlet port is provided. In addition, within the first ink passage of the passage unit, the first space and the second space contiguous to each other are formed on upstream and downstream sides of the filter with the filter interposed therebetween. Each of the first and second spaces has cross-sectional shape and size in the direction perpendicular to the ink flow direction, which are constant along the ink flow direction. As a result, ink that flows from the ink outlet port of the joint member through the ink receiving port of the passage unit into the first ink passage is hardly decreased in flow velocity and pressure around the filter. Therefore, similar advantage to that of the above-mentioned first aspect can be obtained.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Some preferred embodiments of the present invention will hereinafter be described with reference to the accompanying drawings.

Figure 1:
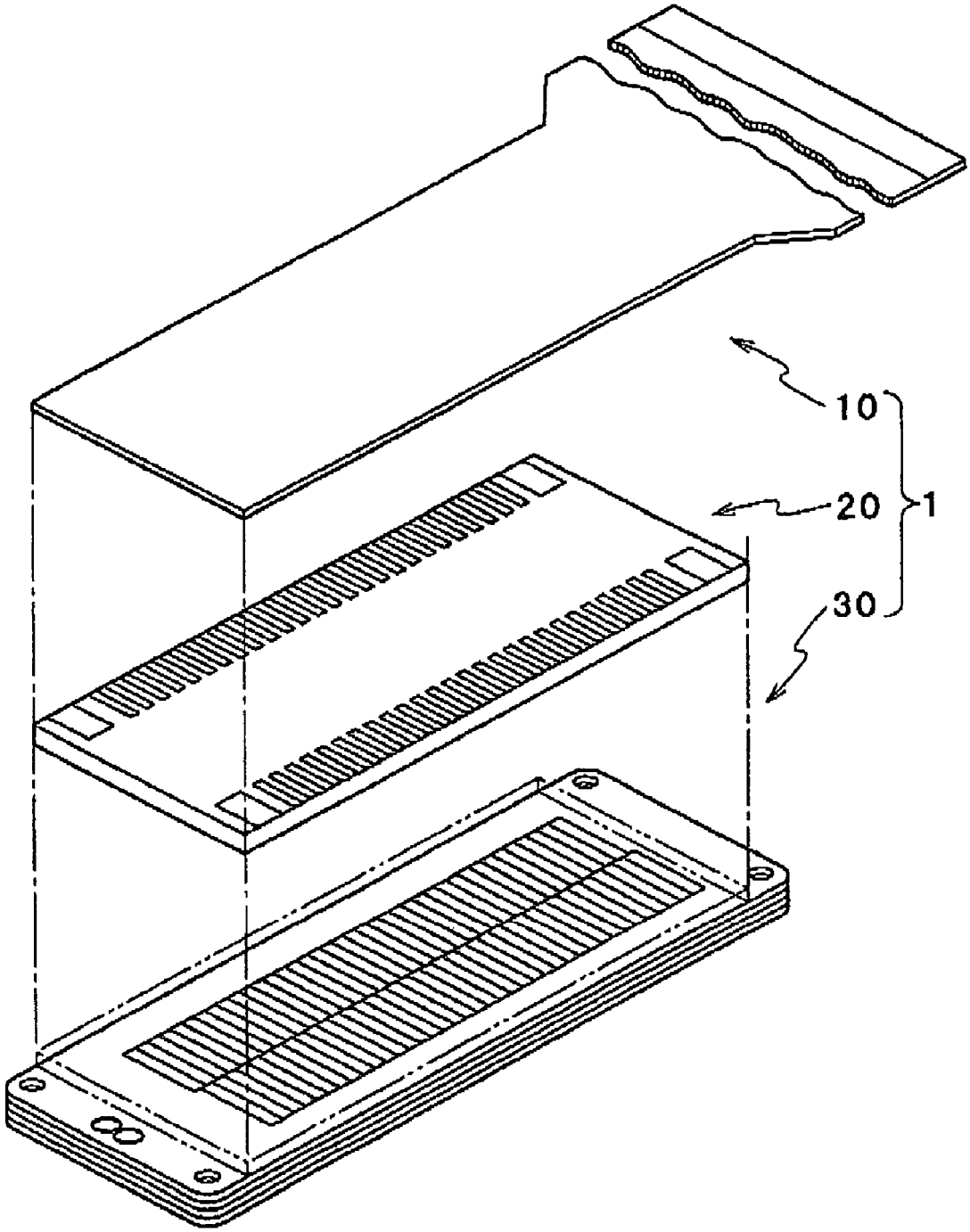
FIG. 1 is an exploded perspective view of an ink-jet head according to a first embodiment of the present invention.

First, an ink-jet head according to a first embodiment of the present invention will be described with reference to FIGS. 1, 2, 3, and 4. As illustrated in FIG. 1, an ink-jet head 1 of this embodiment comprises a passage unit 30, an actuator unit 20, and a flexible printed circuit (FPC) 10, all of which have substantially rectangular planar shapes. The passage unit 30, the actuator unit 20, and the FPC 10 are put in layers in their thickness direction.

The actuator unit 20 serves to change the volume of later-described pressure chambers 48 (see FIGS. 2 and 3) of the passage unit 30. The FPC 10 serves to feed a drive signal to the actuator unit 20. As will be described later, many nozzles 41 (see FIGS. 2 and 3) are formed on a face of the passage unit 30 opposite to its face having the actuator unit 20 layered thereon, i.e., on a lower face thereof that is not shown in FIG. 1. As the actuator unit 20 changes the volume of the pressure chambers 48, the ink is ejected through the nozzles 41.

Figure 2:
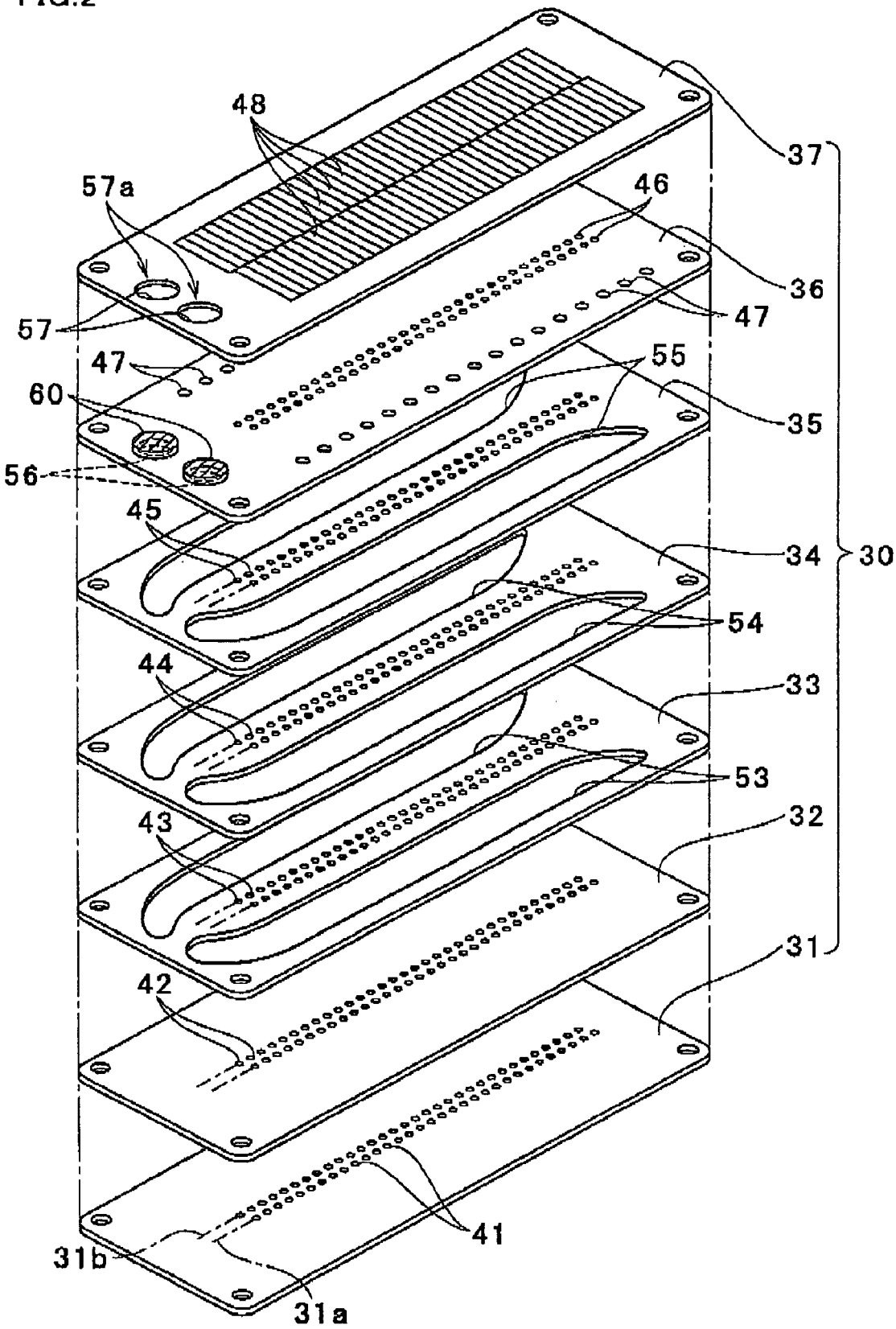
FIG. 2 is an exploded perspective view of a passage unit included in the ink-jet head of FIG. 1.
Figure 3:
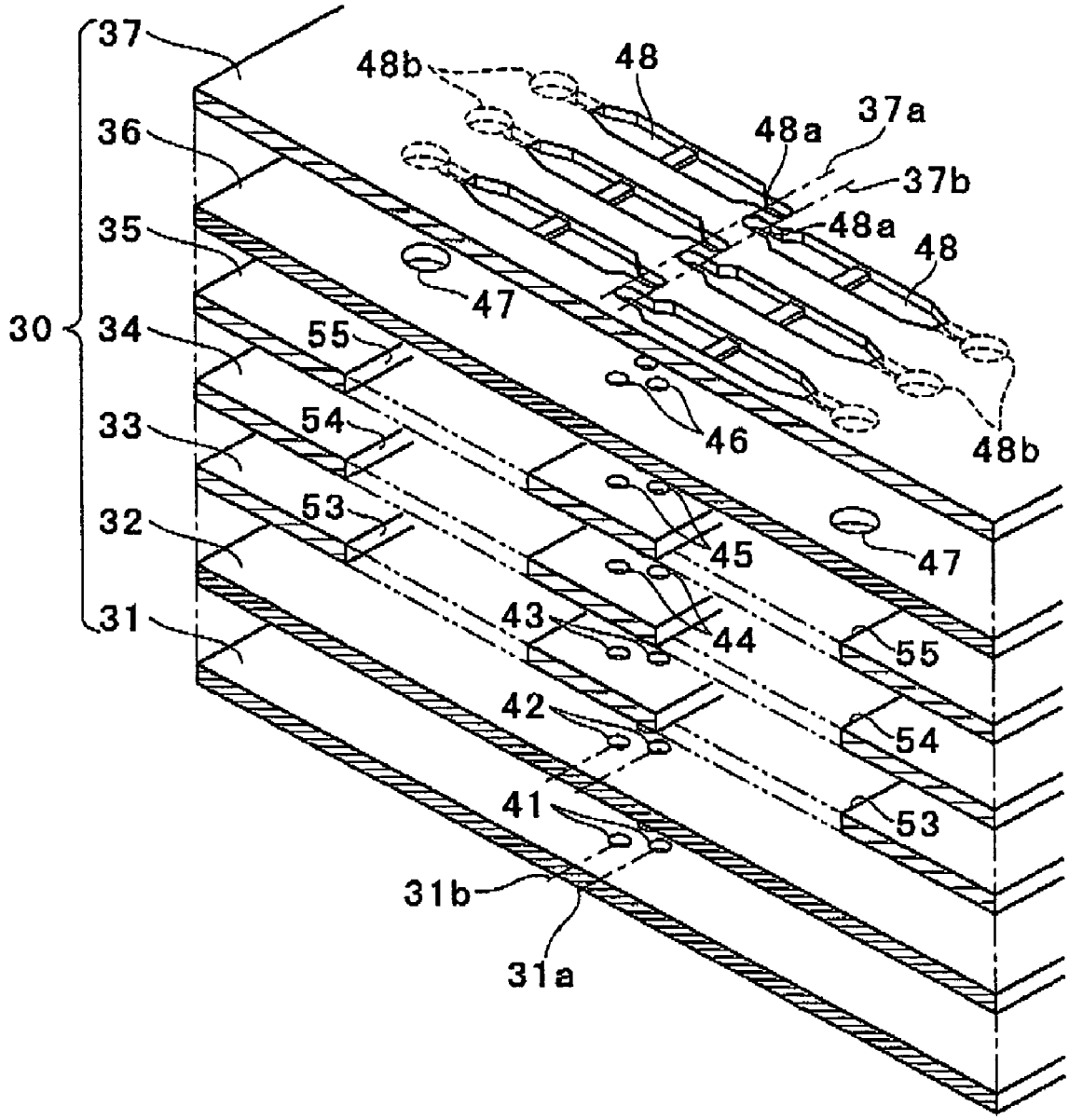
FIG. 3 is a partial enlarged perspective view of the passage unit of FIG. 2.

The actuator unit 20 includes, for example, a plurality of piezoelectric sheets (not illustrated) of flat-plate shape spanning later-described many pressure chambers 48 (see FIGS. 2 and 3) of the passage unit 30; a common electrode (not illustrated) that is disposed between the piezoelectric sheets, shared by the many pressure chambers 4B, and kept at the ground potential; and individual electrodes (not illustrated) disposed at positions corresponding to the respective pressure chambers 48. Voltage application via the FPC 10 to between the common electrode and the individual electrodes causes distortion of the piezoelectric sheet sandwiched between these electrodes, so that the volume of the pressure chambers 48 of the passage unit 30 can selectively be changed. Ink is consequently ejected through the corresponding nozzles 41 of the passage unit 30, As shown in FIGS. 2 and 3, the passage unit 30 has a layered structure of seven metal sheets of substantially rectangular shape, i.e., a nozzle plate 31, a spacer plate 32, three manifold plates 33, 34 and 35, a base plate 36, and a cavity plate 37. As the plates 31 to 37, there may be adopted, for example, plates of Ni—Fe alloy with a thickness of approximately 40 to 150 μm, in which formed are many openings or recesses by means of stamping or etching. The plates 31 to 37 are bonded to one another with an adhesive applied on each plane such that the openings or recesses may communicate with each other.

In the nozzle plate 31, many nozzles 41 each having a minute diameter are formed at a fine pitch in a staggered pattern along two parallel reference lines 31*a* and 31*b* that extend in a lengthwise direction of the nozzle plate 31. The nozzle 41 has, for example, a tapered shape, and ink is ejected from a tip end thereof.

Many holes 42 corresponding to the respective nozzles 41 are formed in the spacer plate 32.

In the three manifold plates 33, 34, and 35, formed are many holes 43, 44, and 45 corresponding to the respective nozzles 41 as well as manifold channels 53, 54, and 55 that extend along a lengthwise direction of the plates. The manifold channels 53, 54, and 55 are formed near both widthwise sides of the plates. When the manifold plates 33 to 35 are put in layers, the manifold channels 53, 54, and 55 are united with each other in a layered direction to form ink passages that extend along a plane of the passage unit 30.

Many holes 46 corresponding to the respective nozzles 41 and many holes 47 are formed in the base plate 36. The many holes 47 aligned along a lengthwise direction are provided near both widthwise sides of the plate, Two substantially circular openings 56 are formed near one lengthwise end of the base plate 36. The two openings 56 are arranged in parallel along a width of the plate, A diameter of each opening 56 is almost the same as a width of the vicinity of one end of the manifold channels 53, 54, and 55. The openings 56 communicate with one end of the manifold channels 53, 54, and 55.

Filters 60 are so disposed on the base plate 36 as to cover the two respective openings 56. The filters 60 have a function of removing dust, etc., contained in ink. Each filter 60 has a substantially circular shape with a diameter larger than that of the opening 56 and with a thickness of approximately 50 to 75 μm.

In the cavity plate 37, many pressure chambers 48 are formed at a distance from each other in two lines on opposite sides of a centerline that is along a lengthwise direction of the plate. Each pressure chamber 48 is formed penetrating through the cavity plate 37 in a thickness direction by means of stamping, and arranged such that its length may, in a plan view, be in parallel with a width of the cavity plate 37. When reference lines 37*a* and 37*b* (see FIG. 3) parallel to the centerline of the cavity plate 37 are defined on opposite left and right sides of the centerline along the lengthwise direction of the cavity plate 37, each pressure chamber 48 arranged on the right side of the centerline has one lengthwise end thereof positioned on the reference line 37*a* that is defined on the left side of the centerline, and each pressure chamber 48 arranged on the left side of the centerline has one lengthwise end thereof positioned on the reference line 37*b* that is defined on the right side of the centerline. In addition, the pressure chambers 48 are so arranged that lengthwise centerlines of the pressure chambers 48 arranged in two lines may alternate with each other in the lengthwise direction of the cavity plate 37. That is, the pressure chambers 48 are arranged in a staggered pattern.

As shown in FIG. 3, an end 48*a* of each pressure chamber 48 nearer the center of the cavity plate 37 communicates through the holes 46, 45, 44, 43, and 42 with the nozzle 41. On the other hand, the other end 48*b* of each pressure chamber 48 is formed in a recessed manner by means of half etching so that it may open only on a lower face side of the cavity plate 37. The other end 48*b* communicates through the hole 47 with the manifold channels 53, 54, and 55.

Moreover, two substantially circular openings 57 arranged parallel in a widthwise direction are formed at such positions near one lengthwise end of the cavity plate 37 as to correspond to the respective openings 56 of the base plate 36. Portions of the openings 57 on an upper face side of the cavity plate 37 serve as ink receiving ports 57*a*. A diameter of each opening 57 is larger than that of the opening 56 of the base plate 36 and almost the same as that of the filter 60, so that the filter 60 may fit in the opening 57 when the cavity plate 37 is put on an upper face of the base plate 36 (see FIG. 4). Since the cavity plate 37 is thicker than the filter 60, an upper face of the cavity plate 37 is positioned above an upper face of the filter 60, as illustrated in FIG. 4.

Figure 4:
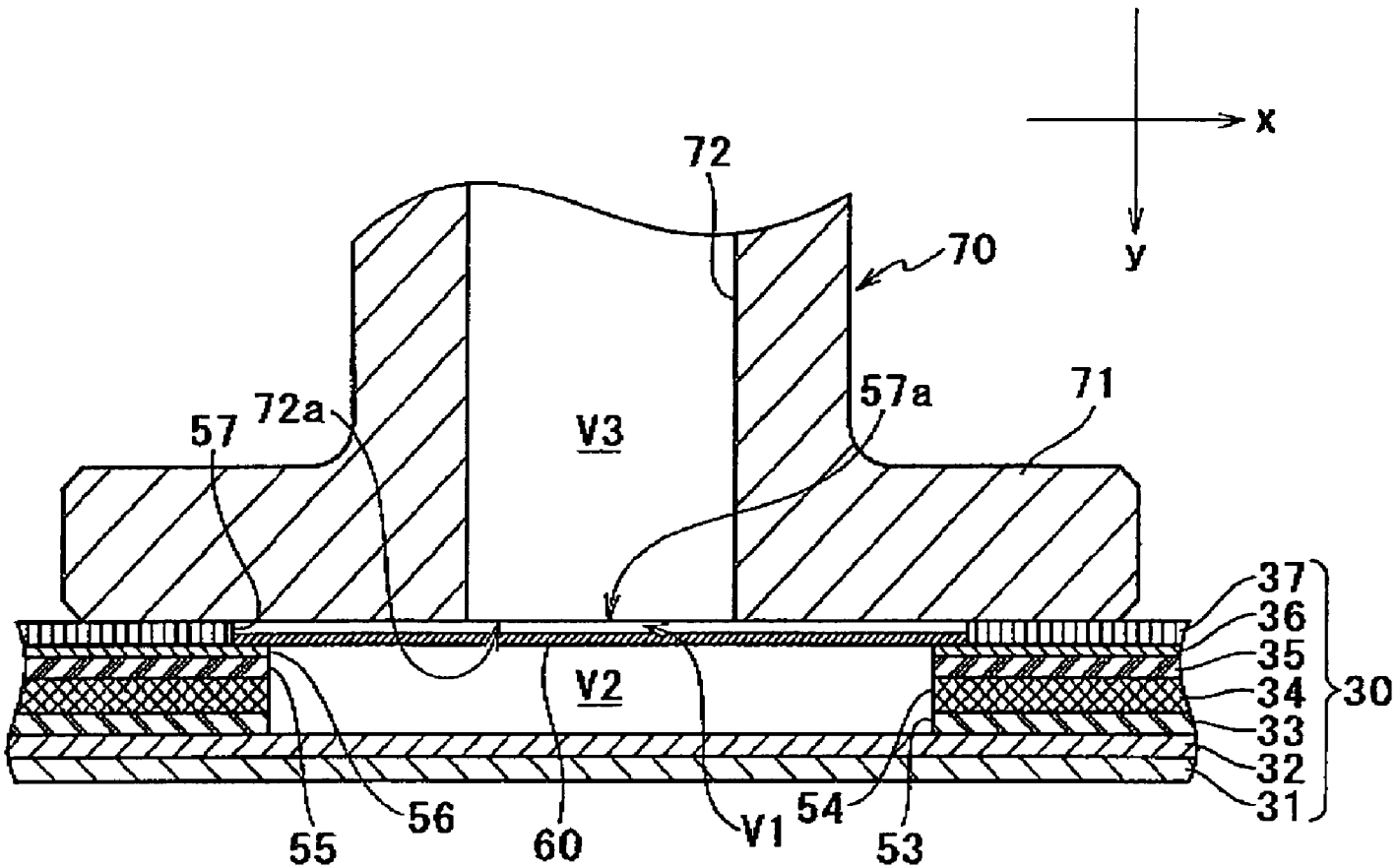
FIG. 4 is a sectional view around one longitudinal end of the passage unit of FIG. 1, illustrating the passage unit and a joint member disposed on the passage unit.

As illustrated in FIGS. 2 and 4, a first ink passage and a second ink passage are formed inside the passage unit 30. The first ink passage has the ink receiving port 57*a* arranged at one end thereof, and extends in a thickness direction of the plates 31 to 37 (i.e., in a direction of an arrow y in FIG. 4). The second ink passage extends from the other end of the first ink passage to the nozzle 41. More specifically, the first ink passage is made up of the ink receiving port 57*a*, the openings 57 and 56, and portions of the manifold channels 53, 54, and 55 opposing the opening 56. The second ink passage is made up of the manifold channels 53, 54, and 55 except for their portions opposing the opening 56, the hole 47, the pressure chamber 48, the holes 46, 45, 44, 43, and 42, and the nozzle 41.

Ink supplied into the passage unit 30 firstly passes through the first ink passage, i.e., through the ink receiving port 57*a*, the openings 57 and 56, and one end of the manifold channels 53, 54, and 55. Then, the ink flows within the manifold channels 53, 54, and 55 in their lengthwise direction, to be distributed, through the hole 47, among the respective pressure chambers 48. The ink reserved in the respective pressure chambers 48 reach the nozzles 41 through the holes 46, 45, 44, 43, and 42.

The filter 60 is, as illustrated in FIG. 4, disposed in the opening 57 in the course of the first ink passage within the passage unit 30 so as to be slightly spaced from the ink receiving port 57*a* on a downstream side.

Next, with reference to FIG. 4, a description will be given to a joint member 70 arranged on the passage unit 30. FIG. 4 illustrates a section of a portion corresponding to only one of the two ink receiving ports 57*a* (see FIG. 2).

The joint member 70 has a substantially cylindrical shape with a substantially column-shaped ink pathway 72. The ink pathway 72 has, at one end thereof nearer the passage unit 30, an ink outlet port 72*a* of substantially circular shape that has a smaller diameter than that of the ink receiving port 57*a*. The joint member 70 is disposed on the passage unit 30 such that the ink outlet port 72*a* may confront the ink receiving port 57*a*.

The other end (not illustrated) of the ink pathway 72 of the joint member 70 is connected to, for example, one end of a tube having the other end thereof connected to an ink tank as an ink supply source. Ink supplied from the ink tank flows through the tube into the ink pathway 72 of the joint member 70, and then through the ink outlet port 72*a* into the ink receiving port 57*a* of the passage unit 30.

Since the ink pathway 72 of the joint member 70 has a substantially columnar shape, the ink pathway 72 has, in the vicinity of one end thereof, a space V3 whose cross-sectional shape and size in a direction perpendicular to an ink flow direction toward the ink outlet port 72*a* (i.e., in a direction of an arrow x in FIG. 4) are constant along the ink flow direction (i.e., along the direction of the arrow y in FIG. 4). A cross-section of the space V3 in the direction of the arrow x has a circular shape with a smaller diameter than those of both the openings 57 and 56 of the passage unit 30.

A flange portion 71 is formed around one end of the joint member 70 having the ink outlet port 72*a* provided thereat, and an outer diameter of the one end is larger than that of the ink receiving port 57*a*. An end face of the joint member 70 at the above-mentioned one end, i.e., a face thereof confronting the passage unit 30 is flat. An adhesive and the like is applied to an outer periphery of this face which is then brought into contact with a circumference of the ink receiving port 57*a* of the passage unit 30, so that the passage unit 30 and the joint member 70 are secured to each other.

Between the ink receiving port 57*a* and the filter 60, formed is a first space V1 in a straight columnar shape whose cross-sectional shape and size in the direction of the arrow x in FIG. 4 are constant along the direction of the arrow y. A length of the first space V1 in the direction of the arrow y, that is, a distance between the upper face of the filter 60 and the ink receiving port 57*a* is approximately 50 μm.

On the other hand, a second space V2 is Formed on the downstream side of the filter 60 (downstream in the direction of the arrow y) within the first ink passage. The second space V2 is contiguous to the first space V1 with an interposition of the filter 60. Similarly to the first space V1, the second space V2 is in a straight columnar shape and has its cross-sectional shape and size in the direction of the arrow x constant along the direction of the arrow y. However, its length in the direction of the arrow y, that is, a distance between a lower face of the filter 60 and an upper face of the spacer plate 32 is larger than that of the first space V1.

As shown in FIG. 4, the flat face of the joint member 70 confronting the passage unit 30, the filter 60, and the spacer plate 32 are parallel to each other.

As described above, in the ink-jet head 1 according to the first embodiment of the present invention, the space V3 whose cross-sectional shape and size in the direction of the arrow x are constant along the direction of the arrow y is formed in the vicinity of one end of the ink pathway 72 of the joint member 70 at which the ink outlet port 72*a* is provided (see FIG. 4). In addition, formed within the first ink passage of the passage unit 30 are the first and second spaces V1 and V2 whose respective cross-sectional shapes and sizes in the direction of the arrow x are constant along the direction of the arrow y. The first and second spaces V1 and V2 are provided on upstream and downstream sides of the filter 60, respectively, to be contiguous to each other. As a result, ink that flows from the ink outlet port 72*a* of the joint member 70 through the ink receiving port 57*a* of the passage unit 30 into the first ink passage is hardly decreased in flow velocity and pressure around the filter 60. Therefore, since air contained in ink is unlikely to develop into bubbles, generation of bubbles around the filter 60 can be suppressed. Further, this suppression of generation of bubbles can prevent deterioration in ejection performance, and moreover malfunctions such as failure of ink ejection.

Besides, a distance between the ink receiving port 57*a* and the filter 60 is shorter than a distance between the filter 60 and the spacer plate 32 on the downstream side of the filter 60. In other words, the first space V1 is shorter in the direction of the arrow y than the second space V2. Thereby, the flow velocity and pressure of ink are further prevented from decreasing on the upstream side around the filter 60 and particularly within the first space V1. Thus, generation of bubbles within the first space V1 is less likely to occur. Even if bubbles are generated, their growth is suppressed. Consequently, deterioration in ejection performance and, further, malfunctions such as failure of ink ejection, which result from bubbles, can effectively be suppressed.

Further, the passage unit 30 has a layered structure of a plurality of plates 31 to 37, with which the first and second spaces V1 and V2 can be formed into predetermined shapes with more ease and at a lower cost as compared with, e.g., a resin-molded passage unit.

The filter 60 is so disposed on, among the plurality of plates 31 to 37, the base plate 36 as to cover the opening 56, and the cavity plate 37 to be put immediately on the base plate 36 has the opening 57 into which the filter 60 is fitted. In this case, by, e.g., setting thicknesses of the filter 60 and the cavity plate 37 at predetermined values, the first space V1 of very small length in the direction of the arrow y can be formed accurately and easily.

Next, an ink-jet head according to a second embodiment of the present invention will be described with reference to FIGS. 5 and 6.

The ink-jet head according to the second embodiment comprises an actuator unit 20, an FPC 10, and a joint member 70, all of which are the same as those of the aforementioned first embodiment, and a passage unit 130 that differs from the passage unit 30 of the first embodiment. The same members as in the first embodiment will be denoted by the same reference numerals, and a description thereof will be omitted.

Figure 5:
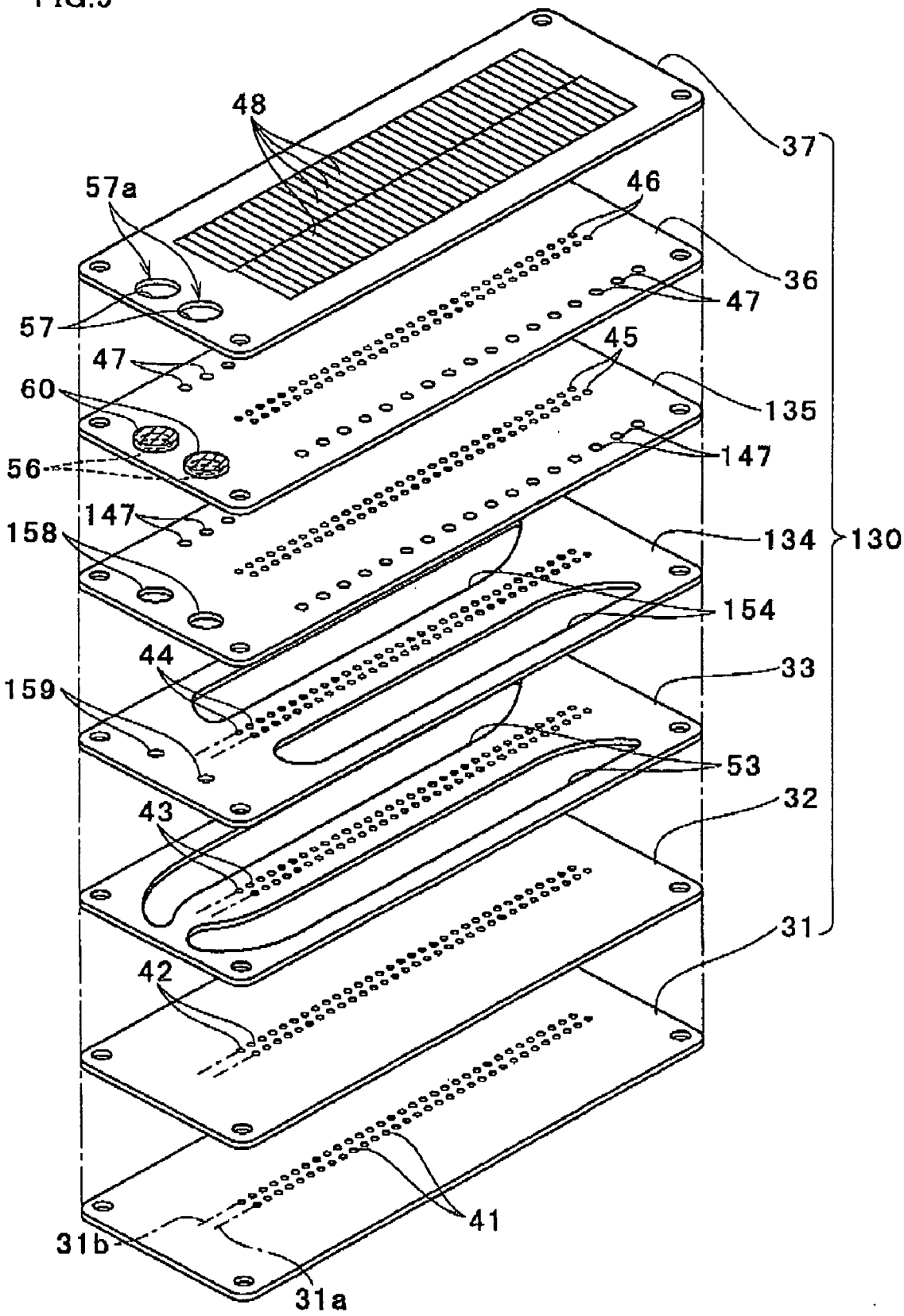
FIG. 5 is a partial enlarged perspective view of a passage unit included in an ink-jet head according to a second embodiment of the present invention.

As seen from FIGS. 2 and 5, the passage unit 130 of this embodiment is different from that of the first embodiment in, among the seven plates, third and fourth plates from an upper side, and the other plates 31 to 33, 36, and 37 are the same as those of the first embodiment.

As illustrated in FIG. 5, differently from the first embodiment, a third plate 135 has holes 147 that correspond to the holes 47 formed in the base plate 36, instead of the manifold channels 55 (see FIG. 2). In addition, two substantially circular openings 158 are formed at such positions near one lengthwise end of the plate 135 as to correspond to the respective openings 56 of the base plate 36. A diameter of each opening 158 is almost the same as that of the opening 56 of the base plate 36.

In a fourth manifold plate 134, on the other hand, manifold channels 154 that extend along a lengthwise direction of the plate are formed near both widthwise sides of the plate. These manifold channels 154 are, however, shorter in the lengthwise direction than the manifold channels 54 (see FIG. 2) of the first embodiment. More specifically, one end of each manifold channel 154 does not reach a position opposing the opening 56 formed in the base plate 36. Two substantially circular openings 159 are formed in the manifold plate 134 at such positions near the above-mentioned one end as to correspond to the openings 56 of the base plate 36. A diameter of each opening 159 is smaller than that of the opening 56 of the base plate 36 and that of the opening 158 of the plate 135, and also than a width of the vicinity of one end of the manifold channel 53 formed in the lower manifold plate 33. Each opening 159 communicates with one end of the corresponding manifold channel 53.

A first ink passage inside the passage unit 130 is made up of the ink receiving port 57*a*, the openings 57, 56, 158, and 159, and a portion of the manifold channel 53 opposing the opening 56. A second ink passage is made up of the manifold channel 53 except for its portion opposing the opening 56, the manifold channel 154, the holes 147 and 47, the pressure chamber 48, the holes 46, 45, 44, 43, and 42, and the nozzle 41.

Figure 6:
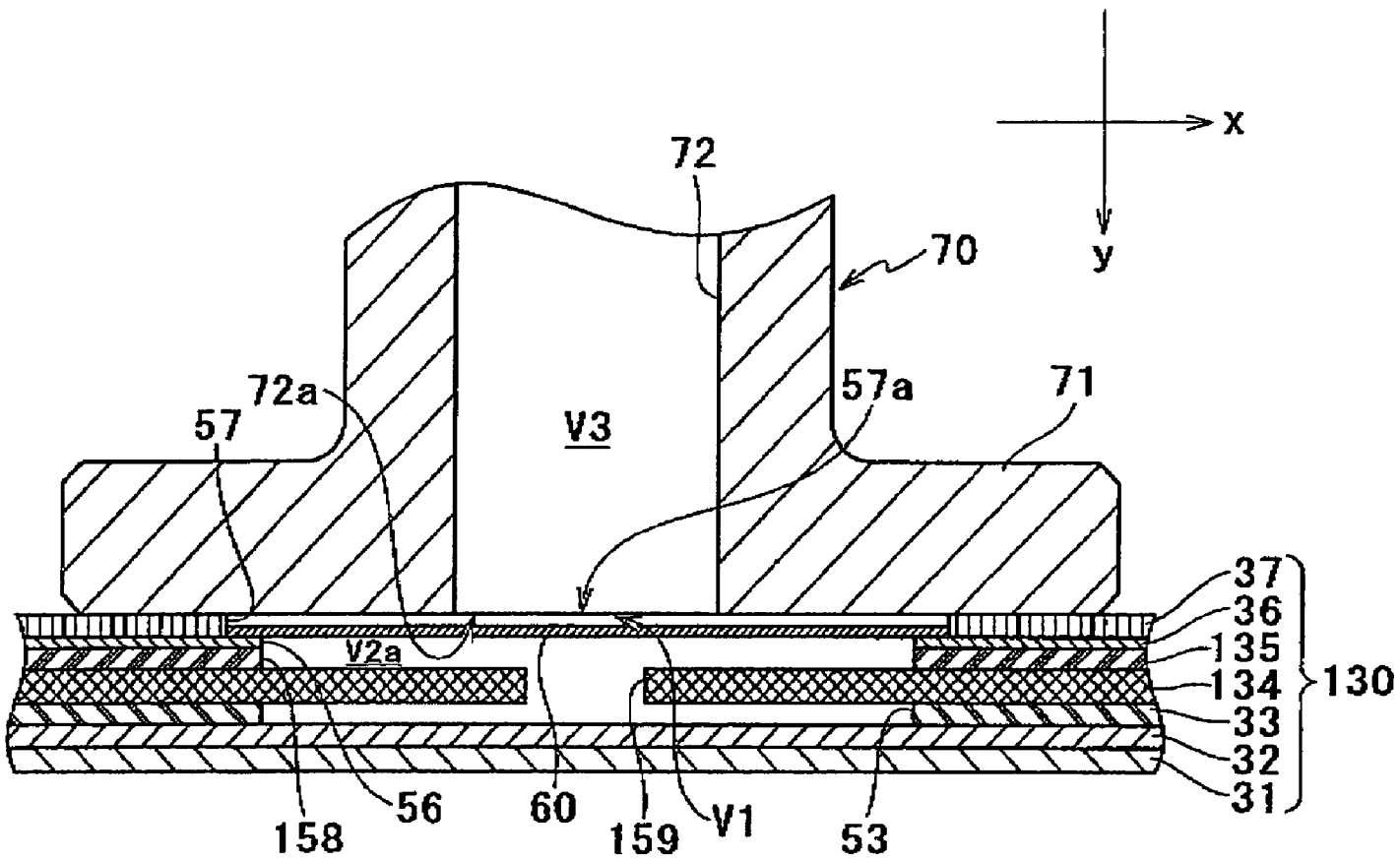
FIG. 6 is a sectional view around one longitudinal end of the passage unit of FIG. 5, illustrating the passage unit and a joint member disposed on the passage unit.

In this embodiment, as illustrated in FIG. 6, a hole (i.e., the hole 159) corresponding to the first ink passage and formed in the manifold plate 134 spaced from the filter 60 on the downstream side is smaller than holes (i.e., the holes 56 and 158, and one end of the manifold channel 53) corresponding to the first ink passage and formed in the other plates 36, 135, and 33 located downstream of the filter 60. Accordingly, the opening 159 functions as a flow regulator. The flow regulator formed by the opening 159 is located at a downstream end of a second space V2*a*. More specifically, an interval between a lower face of the filter 60 and an upper face of the manifold plate 134 having the opening 159 is formed as the second space V2*a*.

As described above, in the ink-jet head according to the second embodiment of the present invention, the flow regulator is formed by the opening 159 at the downstream end of the second space V2*a*, on the downstream side of the filter 60 in the first ink passage. Therefore, flow velocity and pressure of ink are increased around the opening 159 and particularly within the second space V2*a*, so that generation of bubbles is less likely to occur. Even if bubbles are generated, their growth is suppressed. Accordingly, deterioration in ejection performance and, further, malfunctions such as failure of ink ejection, which result from bubbles, can effectively be suppressed.

An ink-jet head according to a third embodiment of the present invention will then be described with reference to FIGS. 7 and 8.

The ink-jet head according to the third embodiment comprises an actuator unit 20, an FPC 10, and a joint member 70, all of which are the same as those of the aforementioned first embodiment, and a passage unit 230 that differs from the passage units 30,130 of the first and second embodiments. The same members as in the first and second embodiments will be denoted by the same reference numerals, and a description thereof will be omitted.

Figure 7:
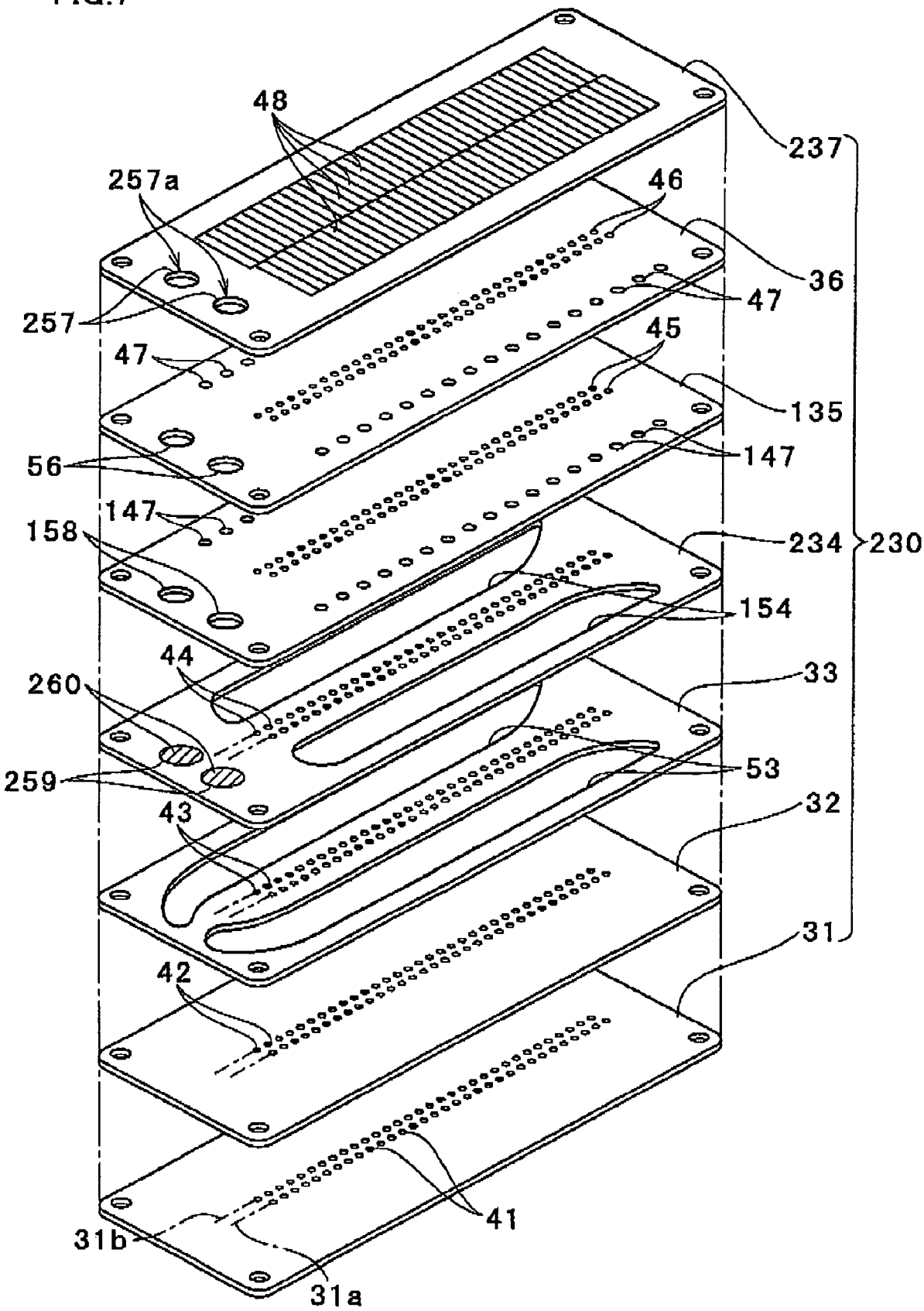
FIG. 7 is a partial enlarged perspective view of a passage unit included in an ink-jet head according to a third embodiment of the present invention.
Figure 8:
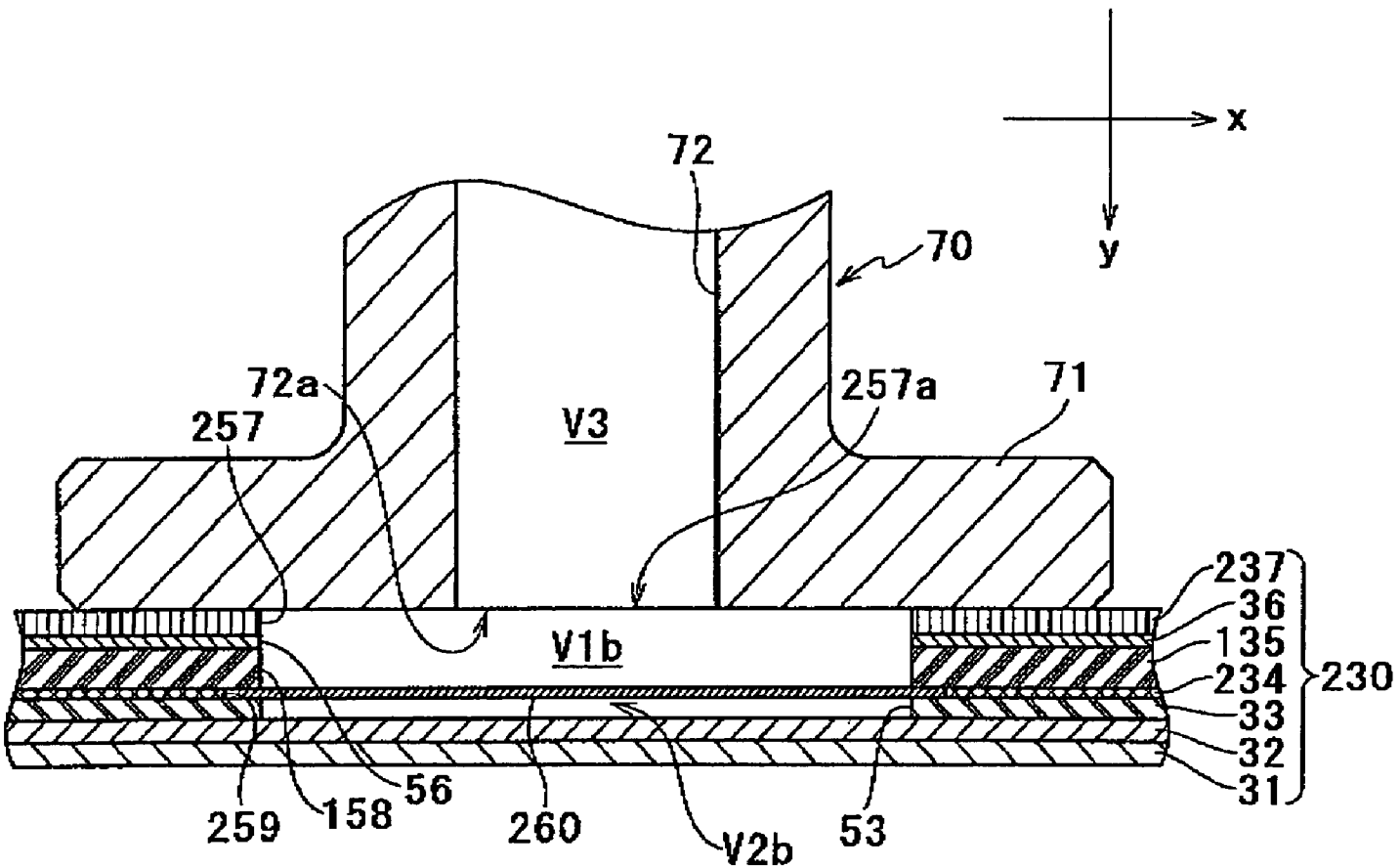
FIG. 8 is a sectional view around one longitudinal end of the passage unit of FIG. 7, illustrating the passage unit and a joint member disposed on the passage unit.

As seen from FIGS. 2 and 7, the passage unit 230 of this embodiment is different from that of the first embodiment in, among the seven plates, first, third, and fourth plates from an upper side. The other plates 31 to 33, and 36 are the same as those of the first embodiment. A third plate 135 is the same as that of the second embodiment.

As illustrated in FIG. 7, a first cavity plate 237 has, near one lengthwise end thereof, two substantially circular openings 257. A diameter of each opening 257 is smaller than that of the opening 57 of the first embodiment, and almost the same as that of the opening 56 of the base plate 36. Portions of the openings 257 on an upper face side of the cavity plate 237 serve as ink receiving ports 257*a*.

On the other hand, a fourth manifold plate 234 has, similarly to the manifold plate 134 of the second embodiment, the manifold channels 154 and the holes 44 formed therein. The fourth manifold plate 234 also has two substantially circular openings 259 formed at such positions near one end thereof as to correspond to the openings 56 of the base plate 36. A diameter of each opening 259 is larger than that of the opening 159 of the second embodiment, and each opening 259 communicates with one end of each manifold channel 53. More specifically, as illustrated in FIG. 8, the opening 259 is larger than any of the holes formed in the other plates and constituting a first ink passage (i.e., than any of the opening 257 of the cavity plate 237, the opening 56 of the base plate 36, and one end of the manifold channel 53 of the manifold plate 33).

The first ink passage inside the passage unit 230 is made up of the ink receiving port 257*a*, the openings 257, 56, 158, and 259, and a portion of the manifold channel 53 opposing the opening 56. A second ink passage is made up of the manifold channel 53 except for its portion opposing the opening 56, the manifold channel 154, the holes 147 and 47, the pressure chamber 48, the holes 46, 45, 44, 43, and 42, and the nozzle 41.

The third embodiment differs from the first and second embodiment also in the location of filters 260. Each filter 260 of this embodiment is, differently from those of the first and second embodiments, not disposed on the base plate 36, but disposed on the manifold plate 33 and within the opening 259 of the manifold plate 234 such that the filter 260 may cover the vicinity of one end of the manifold channel 53. As a result, a first space V1*b* is formed longer in a direction of an arrow y than a second space V2*b*. In other words, the filter 60 is, in the first and second embodiments, disposed nearer to the ink receiving port 57*a* than to the spacer plate 32, while, in this embodiment, the filter 260 is disposed nearer to the spacer plate 32 than to the ink receiving port 257*a*.

In this embodiment, unlike the first and second embodiments, a diameter of the first ink passage is unchanged through the upstream and downstream of the filter 260.

As described above, in the ink-jet head according to the third embodiment of the present invention, a distance between the ink receiving port 257*a* and the filter 260 is longer than a distance between the filter 260 and the spacer plate 32 on a downstream side of the filter 260. In other words, the first space V1*b* is longer in the direction of the arrow y than the second space V2*b*. Therefore, flow velocity and pressure of ink are further prevented from decreasing on the downstream side around the filter 260 and particularly within the second space V2*b*. Thus, generation of bubbles within the second space V2*b* is less likely to occur. Even if bubbles are generated, their growth is suppressed. Consequently, deterioration in ejection performance and, further, malfunctions such as failure of ink ejection, which result from bubbles, can effectively be suppressed.

The filter may not necessarily be disposed on the base plate 36 as in the first and second embodiments or on the manifold plate 33 as in the third embodiment but may be disposed at various positions, as long as those positions are within the first ink passage of the passage unit. By variously changing the location of the filter, the first and second spaces formed on upstream and downstream sides of the filter can be changed in configuration and in size.

The filters 60 or 260 are put in position by being fitted in the opening 57 of the cavity plate 37 in the first and second embodiments or by being fitted in the opening 259 of the manifold plate 234 in the third embodiment. However, this is not limitative, and the filter can be put in position by means of other approaches. Moreover, it is not necessary to form the filter 60 or 260 into a separate member from the cavity plate 37 or the manifold plate 234. For example, many pores that functions as the filter 60 or 260 can be formed in the plate 37 or 234.

Further, as to the first and second spaces in the first ink passage of the passage unit 30, the second space is longer in the ink flow direction in the first and second embodiment, and the first space is longer in the ink flow direction in the third embodiment. However, the first and second spaces may have substantially the same length in the ink flow direction.

Still further, in the first to third embodiments, the passage unit has a layered structure of a plurality of sheet members. However, this is not limitative, and the passage unit may be formed by, e.g., resin-molding, etc.

An application of the ink-jet head according to the present invention is not limited to printers, but also to, for example, ink-jet type facsimiles or copying machines.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a joint member having an ink pathway through which ink supplied from an ink supply source passes, an ink outlet port formed at one end of the ink pathway, and a space which is formed in the vicinity of the one end of the ink pathway and whose cross-sectional shape and size in a direction perpendicular to an ink flow direction toward the ink outlet port are constant along the ink flow direction;

a passage unit having a plurality of nozzles that eject ink, an ink receiving port that is larger than the ink outlet port and receives the ink flowing out of the ink outlet port, a first ink passage that has, at one end thereof, the ink receiving port and extends in the same direction as the ink flow direction toward the ink outlet port, and a second ink passage that extends from the other end of the first ink passage to the nozzles, the passage unit being connected to the joint member such that the ink receiving port confronts the ink outlet port; and a filter disposed within the first ink passage of the passage unit, wherein:

a first space is formed between the ink receiving port and the filter, a cross-sectional shape and size of the first space in the direction perpendicular to the ink flow direction being constant along the ink flow direction;

a second space is formed on a downstream side of the filter within the first ink passage, a cross-sectional shape and size of the second space in the direction perpendicular to the ink flow direction being constant along the ink flow direction; and the first space and the second space are contiguous to each other with the filter interposed therebetween, wherein the first space is greater in the x-direction than the second space.

2. The ink-jet head according to claim 1, wherein the first space is shorter in the ink flow direction than the second space.

3. The ink-jet head according to claim 1, wherein a flow regulator is formed on the downstream side of the filter within the first ink passage, and is located at a downstream end of the second space.

4. The ink-jet head according to claim 1, wherein:

the passage unit has a layered structure of a plurality of sheet members with holes formed therein, the holes constituting the plurality of nozzles, the ink receiving port, the first ink passage, and the second ink passage;

the filter is disposed at a position, on one of the plurality of sheet members, to cover a hole formed in the one sheet member and corresponding to the first ink passage; and a second sheet member put immediately on the sheet member on which the filter is disposed has a hole in which the filter is fitted.

5. The ink-jet head according to claim 1, wherein:

the passage unit has a layered structure of a plurality of sheet members with holes formed therein, the holes constituting the plurality of nozzles, the ink receiving port, the first ink passage, and the second ink passage;

the filter is disposed at a position, on one of the plurality of sheet members, to correspond to the first ink passage; and a hole corresponding to the first ink passage and formed in another one of the sheet members spaced from the filter on the downstream side is smaller than other holes corresponding to the first ink passage and formed in other sheet members.

6. An ink-jet head comprising:

a joint member having an ink pathway through which ink supplied from an ink supply source passes, an ink outlet port formed at one end of the ink pathway, and a space which is formed in the vicinity of the one end of the ink pathway and whose cross-sectional shape and size in a direction perpendicular to an ink flow direction toward the ink outlet port are constant along the ink flow direction;

a passage unit having a plurality of nozzles that eject ink, an ink receiving port that is larger than the ink outlet port and receives the ink flowing out of the ink outlet port, a first ink passage that has, at one end thereof, the ink receiving port and extends in the same direction as the ink flow direction toward the ink outlet port, and a second ink passage that extends from the other end of the first ink passage to the nozzles, the passage unit being connected to the joint member such that the ink receiving port confronts the ink outlet port; and a filter disposed within the first ink passage of the passage unit, wherein:

a first space is formed between the ink receiving port and the filter, a cross-sectional shape and size of the first space in the direction perpendicular to the ink flow direction being constant along the ink flow direction;

a second space is formed on a downstream side of the filter within the first ink passage, a cross-sectional shape and size of the second space in the direction perpendicular to the ink flow direction being constant along the ink flow direction; and the first space and the second space are contiguous to each other with the filter interposed therebetween, wherein the first space is longer in the ink flow direction than the second space.

* * * * *